US005713615A

United States Patent [19]

Tsai

[11] Patent Number: 5,713,615

[45] Date of Patent: Feb. 3, 1998

[54] STRETCHABLE DOOR KNOB COVER

[76] Inventor: Hsu-Hei Tsai, 1675 Cornelius Ave., Wantagh, N.Y. 11793

[21] Appl. No.: 691,332

[22] Filed: Aug. 2, 1996

[51] Int. Cl.[6] ..... E05B 1/00

[52] U.S. Cl. ..... 292/347; 292/DIG. 2

[58] Field of Search ..... 292/347, DIG. 2

[56] References Cited

U.S. PATENT DOCUMENTS

| | | | |
|---|---|---|---|
| D. 297,107 | 8/1988 | Jones | D8/322 |
| D. 336,584 | 6/1993 | Clacher | D6/610 |
| D. 349,445 | 8/1994 | Addison | D8/322 |
| 1,633,988 | 6/1927 | Jones | 292/DIG. 2 X |
| 1,668,716 | 5/1928 | Herdman | 292/DIG. 2 X |
| 2,610,877 | 9/1952 | Weaver | 292/DIG. 2 X |
| 2,699,809 | 1/1955 | Nebe et al. | 292/DIG. 2 X |
| 2,781,220 | 2/1957 | Zietlow | 292/DIG. 2 X |
| 3,024,555 | 3/1962 | Abeles | 292/347 |
| 3,082,028 | 3/1963 | Werle | 292/DIG. 2 X |
| 3,306,643 | 2/1967 | Reed | 292/347 |
| 3,343,578 | 9/1967 | Rubiin | 292/DIG. 2 X |
| 4,856,140 | 8/1989 | Visco et al. | 292/DIG. 2 X |
| 4,869,305 | 9/1989 | Jones | 150/155 |

*Primary Examiner*—Rodney M. Lindsey

[57] ABSTRACT

A doorknob cover that provides a means for improving the appearance and feel of a doorknob while retaining the rotation and function of the doorknob. The cover, made of soft cloth-like material, is shaped similar to a doorknob with a spherical head, narrower neck and wider base. Openings along the neck of the cover and the flexibility of the material allow the base and neck of the cover to stretch and fit over the doorknob. A string is laced through the neck of the doorknob cover, then tied tightly to secure the cover on the doorknob so that it cannot be removed by pulling. The underside of the cover is coated with a layer of rubber-like material that promotes friction against the surface of the doorknob to allow easy operation of the doorknob without the cover slipping. The coating will also prevent the transfer of static electricity from the metal of the doorknob to the hand. In addition, the soft cover will protect the hand from the coldness of metal doorknobs during cold weather. Furthermore, the cover will also provide cushioning against the hardness of the doorknob, thus reducing the force of impact when the doorknob collides with people or objects.

5 Claims, 2 Drawing Sheets

STRETCHABLE DOOR KNOB COVER

BACKGROUND-FIELD OF INVENTION

This invention relates generally to devices that cover doorknobs. More specifically, it relates to devices that fit over a doorknob and cover its base to improve its appearance and operation.

BACKGROUND-DESCRIPTION OF PRIOR ART

The doorknob is used throughout the day and night. It serves a functional purpose but usually neither matches nor complements the decor of its setting. Design inventors in the past have developed several devices intended to cover the doorknob with something more attractive. U.S. Pat. No. D. 336,584, an ornamental design for a "keep out" doorknob cover, only fits over the knob and does not cover the base. U.S. Pat. No. D. 297,107 and D. 349,445 are ornamental designs of doorknob covers resembling a cow's head and a dolly respectively. These two designs may be suited to children's rooms, but they are not appropriate for other rooms. U.S Pat. No. 4,869,305, a cloth doorknob cover, was not designed for its visual appeal but for the purpose of defeating the facile rotation of a doorknob. All the prior arts described above reduce the functional ability of a doorknob to turn easily because they lack a high friction material on the underside of the cover to provide a grip between the doorknob and the cover. Also, having these covers installed blocks access to keyholes and locks on doorknobs; therefore the covers must be removed for keys to be used which is very inconvenient.

There exists a need for an improved doorknob cover with both functional and aesthetic attributes, but the prior art neither teaches nor suggests how a superior device could be provided.

OBJECTS AND ADVANTAGES (a) to provide a material covering for a doorknob and its base in a variety of colors and styles.

(b) to provide a cover that is stretchable fittng all doorknob sizes.

(c) to provide a softer surface that is more agreeable to the touch than the common hard, metal doorknob.

(d) to provide a covering to reduce the severity of injuries when a person bumps into the doorknob.

(e) to provide a covering that will help protect walls from the impact of collision against doorknobs.

(f) to provide a high friction material between the doorknob and the cover to allow for easier turning of the doorknob.

(g) to provide a block to the transfer of static electricity from the metal of the doorknob to a hand.

(h) to provide protection for the hand against the cold feeling of the metal doorknob, especially during cold weather.

(i) to provide a secure installation of the cover on the doorknob.

(j) to provide a means to keep to the doorknob clean and reduce the transfer of germs.

(k) to provide access to keyholes and locks on the doorknob while the cover is fully installed.

Further objects and advantages are to provide a cover that is simple to install and remove from the doorknob, with or without the use of a variety of accessories. Still further objects and advantages will become apparent from a consideration of the ensuing description and drawings.

DRAWING FIGURES

REFERENCE NUMERALS IN DRAWINGS

The numbers that begin with the letter C refer to parts of the cover and the numbers that begin with the letter A refers to accessories to the cover.

| | |
|---|---|
| C1 face of the cover | A1 eyes |
| C2 base/edge of the cover | A2 string |
| C3 neck of the cover | A3 bead |
| C4 diamond shaped opening | A4 soft stretchable band |
| C5 keyhole/lock opening | |
| C6 small string hole | |
| C7 outer layer | |
| C8 inner layer | |

DESCRIPTION OF INVENTION

Figure 1:
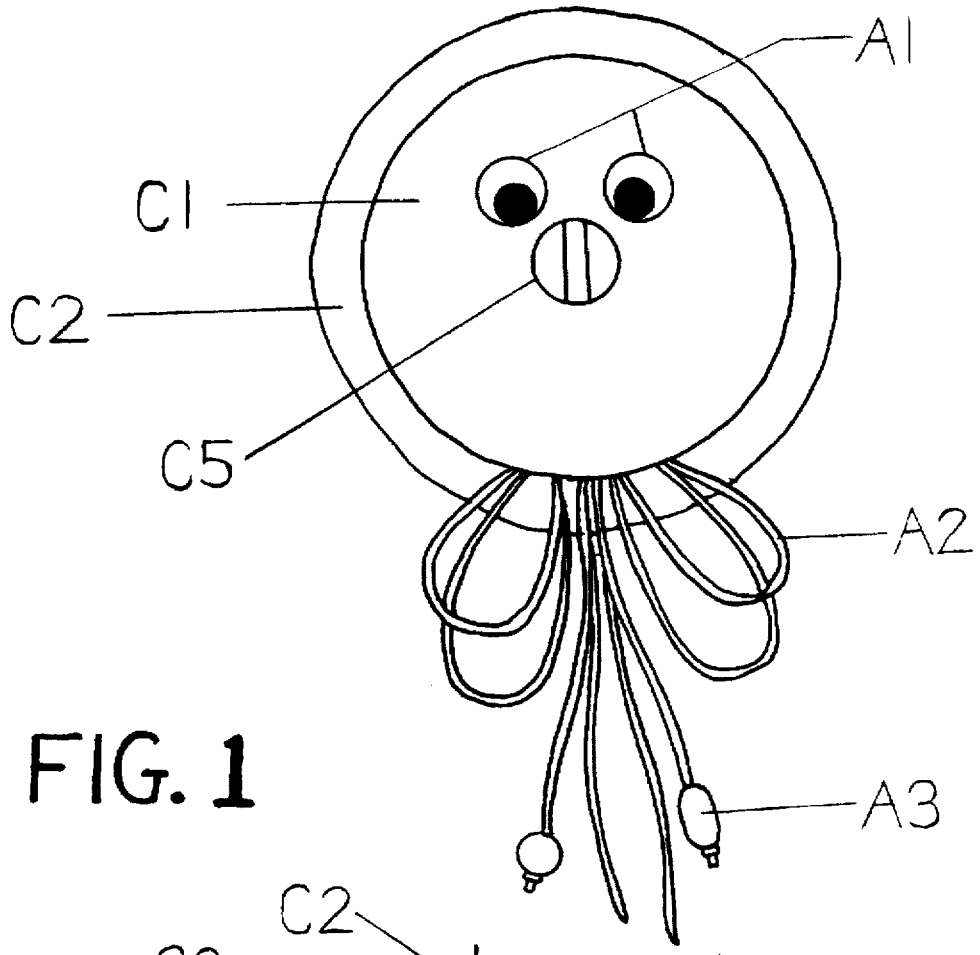
FIG. 1 shows a frontal view of the doorknob cover fully installed with all accessories attached.
Figure 2:
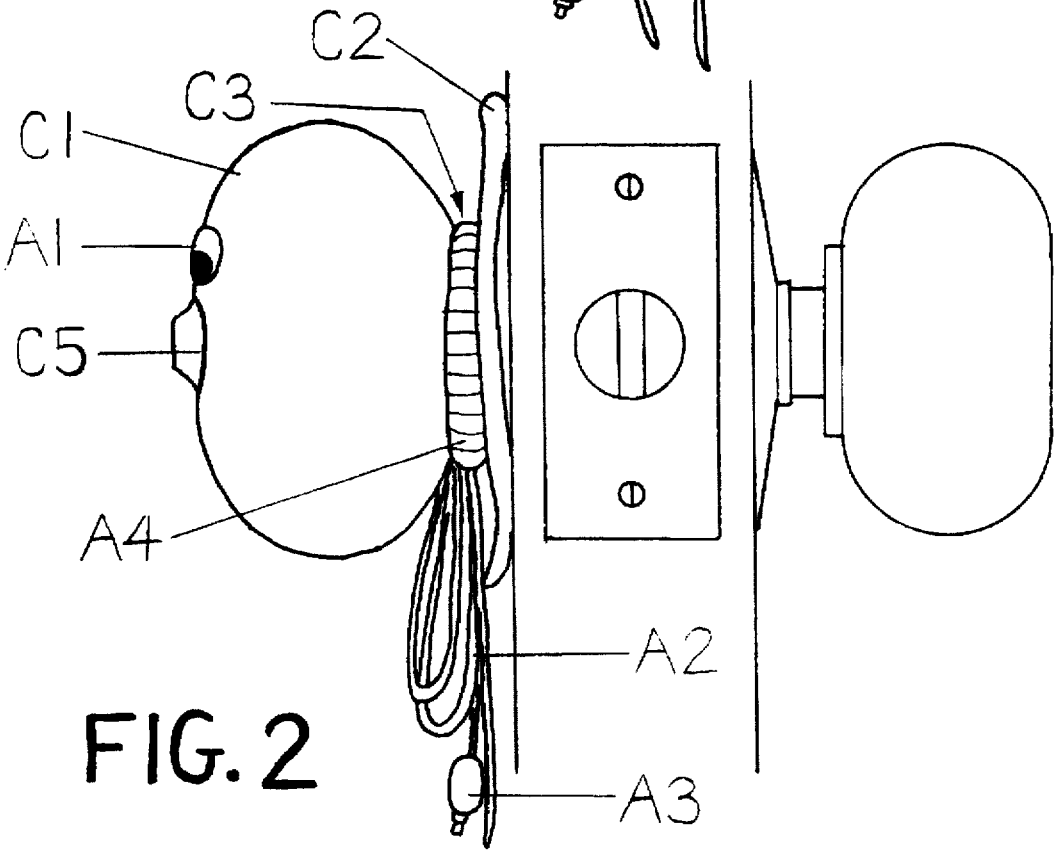
FIG. 2 shows a side view of a door with the doorknob cover fully installed with all accessories (left side) and a bare doorknob (right side).

FIG. 1 and 2 show a doorknob cover fully installed with all accessories attached. The doorknob cover is made of a stretchable material, therefore all the following dimensions given for the parts of the cover are only approximate since the doorknob cover can expand and shrink to different sizes.

Figure 3:
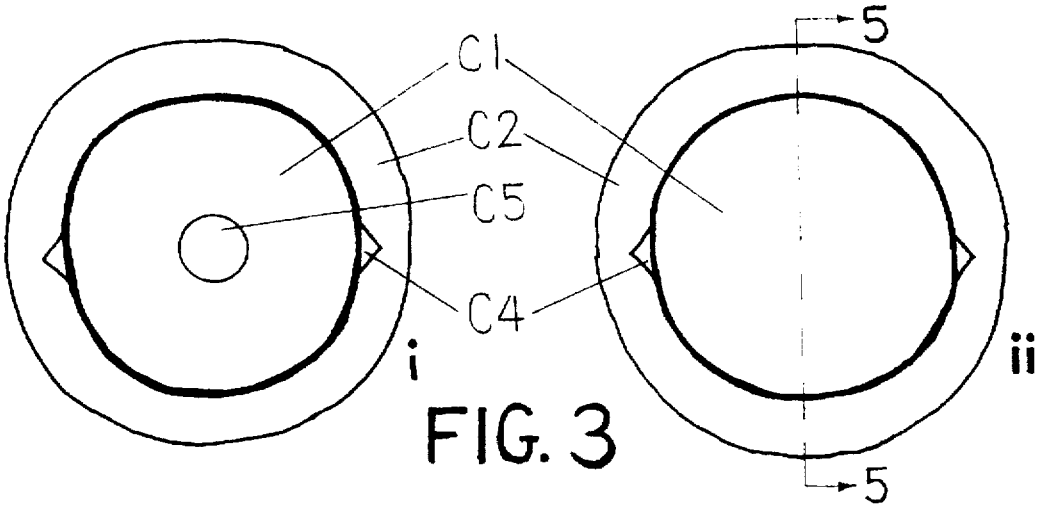
FIG. 3 shows the top view of two doorknob covers: (i) one with a keyhole opening and (ii) one without a keyhole opening.

As shown in FIG. 3, the top view of the doorknob cover, a face C1 of the cover is approximately 2 inches in diameter and can be stretched to fit most doorknobs. The face C1 can be equipped with a keyhole opening C5 if necessary. The keyhole opening C5 is about half an inch in diameter and is stretchable.

The volumetric shape of the cover is similar to that of a sphere connected to a base by a short neck. Looking at FIG. 4, the diameter of the cover increases from the center of the face C1 through the body to the largest diameter of about 2 inches and then decreases to the smallest diameter of a neck C3 of about 1.5 inches. From the neck C3 to an edge C2, the diameter increases from 1.5 to approximately 3 inches.

Figure 4:
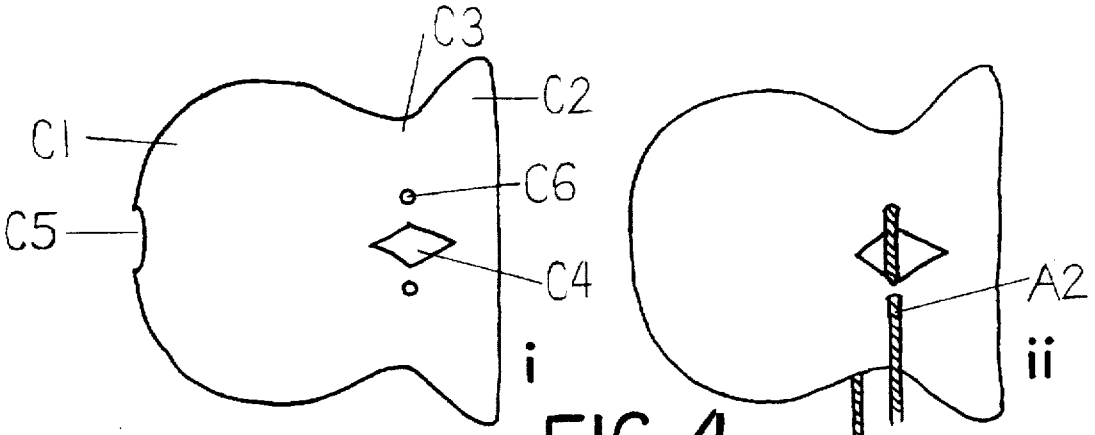
FIG. 4 shows the side view of two doorknob covers: (i) one with a keyhole opening and (ii) one without a keyhole opening and with an attached string.

The edge or base C2 of the cover is stretchable to over 4 inches. FIG. 4, a side view, shows the position of a diamond shaped opening C4 on the cover. Two diamond shaped openings C4 are evenly spaced along the neck C3 of the cover. The diamond shaped opening C4 runs from the edge C2 though the neck C3 of the cover. The two opposite corners of each diamond shaped opening C4 lie on the narrowest part of the neck C3. The diamond shaped openings C4 allows the edge C2 to stretch to over 4 inches in diameter and the neck C3 to stretch to over 2 inches in diameter. The stretchability allows the cover to slip over doorknobs of different shapes and sizes without restriction.

Figure 5:
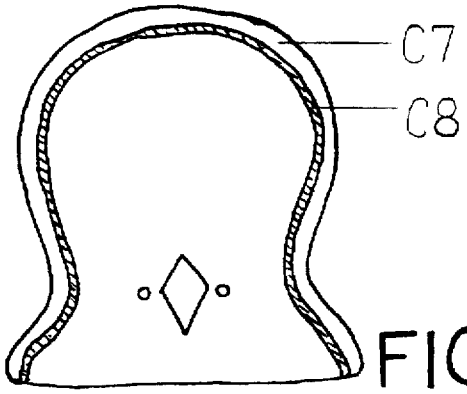
FIG. 5 shows the longitudinal section of the doorknob cover.

FIG. 5, a longitudinal section, shows the inner layer of the cover. An outer layer C7 of the doorknob cover can be composed of, but not limited to, natural materials such as cotton and wool, synthetic and semi-synthetic materials such as acrylic and acrylic blends. The outer layer C7 can be manufactured by, but not limited to, the process of knitting. The outer layer C7 can be dyed to different colors and patterns. The thickness of the outer layer C7 can be as thin as, but not limited to, 1 mm depending on the material used. An inner layer C8 is a coating of a material including, but not limited to, rubber that is stretchable and posses a high frictional coefficient. The inner layer C8 fully coats the under side of the outer layer C7. The inner layer C8 is either clear or dyed to match the color of the outer layer C7.

Figure 6:
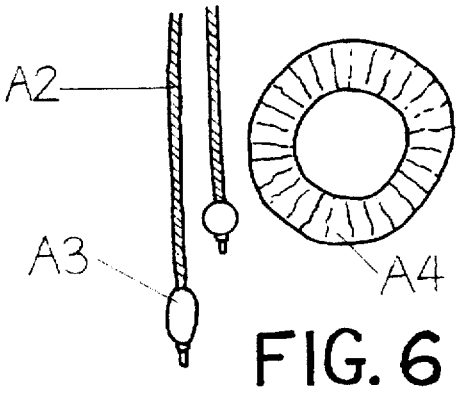
FIG. 6 shows the accessories to the doorknob cover unattached.

FIG. 6 shows the available optional accessories that can be added to the cover. A string A2 has beads A3 secured at its ends. FIG. 4 shows where the string A2 is laced through small holes C6 of the cover. The string holes C6 are located next to the two corners of the diamond shaped opening C4 on the neck C3 of the cover. The bead A3 is larger in size than the string hole C6 so that the string A2 cannot be pulled off the cover. The bead A3 can be of several different shapes and colors. A soft material-wrapped elastic band A4 is about one inch in diameter and can stretch over two inches in diameter. The string A2, the bead A3 and the stretchable band A4 can all be dyed assorted colors like the cover. FIG. 1 and 2 shows eyes A1 attached to the face C1 of the cover. The accessory eyes A1 are available in a variety of sizes, colors and shapes. In FIG. 1 and 2 all the accessories are attached to the cover in the preferred manner.

OPERATION OF THE INVENTION

The installation of the doorknob cover begins with slipping the cover over the doorknob. The diamond shaped opening C4 stretches to increase the diameter of the neck C3 so that it is large enough to slip over the knob. After the cover is on the doorknob, the ends of string A2 that was pre-strung through the holes C6 are pulled to close the diamond shaped openings C4. Each of the ends of string A2 is fixed with bead A3 so that the string A2 cannot be pulled off the cover through the hole C6. The string A2 is tied at the neck C3 to fix the size of the neck C3 so that the cover cannot be pulled off the doorknob since the neck C3 is now too small and no longer stretchable. The security of the attachment of the cover to the doorknob prevents small children or pets from removing the cover and swallowing it. The installer of the cover can tie the string A2 in different manners for personal decorative appeal. The soft elastic band A4 is then slipped over the knob and placed on the neck of the cover to hide the remains of the openings C4, if any, and to further secure the attachment of the cover. The cover and its accessories can be chosen from a variety of colors to complement one another and to match the decor of the room. The doorknob cover is pleasant to look at and provides an added decorative touch to each room.

The material of the outer layer C7 is more pleasant to touch than uncovered doorknobs since people seem to prefer softer feeling objects to hard ones. In cold weather, the cover will protect people's hands from the coldness of the doorknob because the cover will prevent heat loss from the hand to the metal of the doorknob. The rubber-like coating C8 is to provide friction between the doorknob and the cover so that the knob can be mined without the cover slipping. The coating C8 will also prevent the transfer of static electricity from the metal of the doorknob to the hand, thereby reducing static shocks. The cover will provide cushioning protection for when people bump into the doorknob, thus lessening the severity of injuries. The cushioning will also prevent damage to a wall when the doorknob collides against it.

Another option that is available to the cover is the keyhole/lock opening C5 which allows key and lock access while the cover is in place. The cover can also be equipped with eyes A1 making the cover more appealing to look at for children as well as adults. The function of the doorknob cover is to make the doorknob more pleasant to see and operate.

SUMMARY, RAMIFICATIONS, AND SCOPE

Accordingly, the reader will see that the doorknob cover is an invention that will enhance a small aspect of each home or office. The cover can be easily and securely installed on doorknobs of assorted sizes and shapes because of its design to stretch and fit properly. Once installed, the securely fitted cover with its frictional rubber coating C8 allows easy operation of the doorknob while giving a pleasant, soft, cushioning touch to the hard doorknob. The rubber-like coating C8 will also prevent static electric shocks from the metal of the doorknob. The cushioning effect of the cover will reduce injuries when people bump into the doorknob. An additional advantage is that when the doorknob cover becomes dirty it can be easily removed and machine washed to reduce the spread of germs from hand to hand. With all the practical advantages of installing a doorknob cover there is also the aesthetic one; the installer can personally choose from a variety of colors and accessories to match and enhance the decor of each room.

Although the previous description contains many specificities, these should not be construed as the limiting scope of the invention but as merely providing illustrations of some of the presently preferred embodiments of this invention. Additional modifications are different types of diamond shaped openings C4 on the cover. The number of openings C4 can be changed depending on the variations in the size of the openings C4. For example, one opening C4 that is larger than four small openings C4 can be just as effective for the stretching of the cover. The opening C4 can also be extended past the edge C2, separating the edge C2 into unconnected pieces. This allows the base C2 and neck C3 to stretch more than a connected edge C2. The number of openings and the way in which it is placed will depend on what is easier to manufacture and use. The inner coating C8 can also be varied as long as the material used will block static electricity and promote friction. The manufacturer's application of the coating can also vary to use the smallest mount necessary or to apply the coating to specific areas in a certain pattern to be more cost effective. The placing of string holes C6 can also be varied for different patterns of the threading of the string A2 though the neck C3. Other ramifications will depend on if the installer chooses to use or omit certain accessories. For example, the string A2 can be removed leaving only the soft elastic band A4 in place, making the cover less resistant to tugging but still securely installed for regular doorknob use.

Thus, the scope of the invention should be determined by the appended claims and their legal equivalents that include the examples given.

I claim:

1. A device that covers a doorknob and its base, that enhances and retains the operating function of the doorknob, comprising:

a piece of stretchable knitted material;

said piece of material having a predetermined volume and geometrical configuration similar to a doorknob, having a spherical head connected to a smaller neck that is connected to a larger base and having a size sufficient to overlie the doorknob including a head, axle and base of the doorknob;

an inner coating of stretchable material attached to an underside of said piece of stretchable knitted material for enhancing friction between the device and the doorknob;

said inner coating having generally the same geometric configuration of said piece of material;

said inner coating lies on the underside of said piece of material so that the inner coating is fully covered by the said piece of material;

the knitted material and inner coating defining a cavity for receiving the doorknob;

an opening to the doorknob receiving cavity is defined by a peripheral edge of the said piece of materials;

a diamond shaped opening along the neck of the said materials that allow the peripheral edge and necks to stretch from a size less than that of the head of the doorknob to a larger size to slip over the doorknob and then return to its original size such that the neck fits the axle and the larger base covers the base of the doorknob.

2. The device of claim 1, further including more said diamond shaped openings along the neck of the device.

3. The device of claim 1, further including decorative moving eyes attached to the head of the device.

4. The device of claim 1, further including a stretchable circular loop made of elastic and threaded materials knitted together, that can be stretched over the head and fitted around the neck of the device to cover the diamond shaped opening.

5. The device of claim 1, further including small punctures along the neck on either side of the diamond shaped opening of the device, and a string that is strung through said small punctures to be tied to fix the size of the neck of the device so that the device cannot be pulled off the doorknob.

* * * * *